US009725219B2

(12) United States Patent
Zuser et al.

(10) Patent No.: US 9,725,219 B2
(45) Date of Patent: Aug. 8, 2017

(54) BOTTLE FOR WITHDRAWING GOODS THAT ARE IN THE FORM OF PIECES

(75) Inventors: Wilhelm Zuser, Hofstetten (AT); Robert Afflenzer, Weinburg (AT); Günter Ziegelwanger, Hofstetten (AT)

(73) Assignee: Constantia Teich GmbH (AT)

( * ) Notice: Subject to any disclaimer, the term of this patent is extended or adjusted under 35 U.S.C. 154(b) by 500 days.

(21) Appl. No.: 13/818,820

(22) PCT Filed: Aug. 9, 2011

(86) PCT No.: PCT/AT2011/000339

§ 371 (c)(1),
(2), (4) Date: May 31, 2013

(87) PCT Pub. No.: WO2012/024707

PCT Pub. Date: Mar. 1, 2012

(65) Prior Publication Data

US 2013/0240525 A1 Sep. 19, 2013

(30) Foreign Application Priority Data

Aug. 25, 2010 (EP) ..... 10450135

(51) Int. Cl.

| | |
|---|---|
| ***B65D 51/22*** | (2006.01) |
| ***B65D 77/20*** | (2006.01) |
| ***B65D 83/04*** | (2006.01) |

(52) U.S. Cl.

CPC ..... *B65D 51/22* (2013.01); *B65D 77/206* (2013.01); *B65D 83/0427* (2013.01); *B65D 2577/205* (2013.01)

(58) Field of Classification Search

CPC ..... B65D 51/22; B65D 51/228; B65D 17/16; B65D 17/161; B65D 51/18; B65D 17/163; B65D 17/165; B65D 51/20

(Continued)

(56) References Cited

U.S. PATENT DOCUMENTS 7,789,262 B2 * 9/2010 Niederer et al. ..... 220/359.3
8,025,171 B2 * 9/2011 Cassol et al. ..... 220/270

FOREIGN PATENT DOCUMENTS

EP 1 592 488 A1 10/2005

OTHER PUBLICATIONS

Bridault, Alain, "International Search Report" in connection with related PCT Application Serial No. PCT/AT2011/000339, dated Nov. 14, 2011, 2 pages.

(Continued)

*Primary Examiner* — Andrew Perreault
(74) *Attorney, Agent, or Firm* — Kolisch Hartwell, P.C.

(57) ABSTRACT

A bottle, especially a pharmaceutical bottle, configured to facilitate the withdrawal of goods present in the bottle in the form of pieces, the bottle being closed by a lid that consists of at least two layers: a cover layer and an outer layer. The cover layer, which may be a multilayer structure, is firmly sealed to the peripheral, circular sealing edge of the pharmaceutical bottle along said sealing edge, and includes a separation line off-set from the center of the circle. The outer layer, which may also be a multilayer structure, is connected to the cover layer across the entire surface thereof in such a way that one layer can be peeled off. The separation line of the cover layer has a concave section in the portion thereof that is next to the sealing edge, so as to form a flap section when the outer layer is peeled off.

10 Claims, 3 Drawing Sheets

Figure 2:
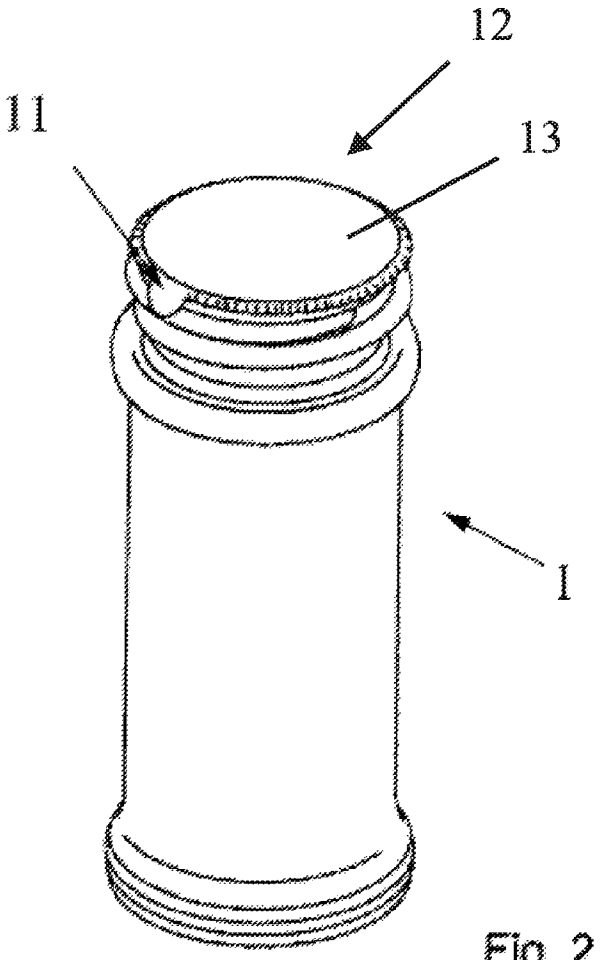

(58) Field of Classification Search
USPC ..... 220/257.2, 258.3, 270, 265, 266, 277, 220/258.5, 359.1, 359.2, 359.3; 215/232, 215/250, 251, 347
See application file for complete search history.

(56) References Cited

OTHER PUBLICATIONS

Bridault, Alain, "Written Opinion" in connection with related PCT Application Serial No. PCT/AT2011/000339, dated Nov. 14, 2011, 6 pages.

* cited by examiner

BOTTLE FOR WITHDRAWING GOODS THAT ARE IN THE FORM OF PIECES

The invention relates to a bottle, in particular a medicine bottle, for pills, tablets, coated tablets, powders, and other goods offered in the form of pieces, such as medicines, food supplements, flavorings, sweeteners, colorants and preservatives, and also foods such as grains or nuts, which are present in the bottle in loose form, and especially to a closure for such a bottle, corresponding to the preamble of claim 1 and to DE 195 23 754.

This document generally discloses a film lid for closing containers, with a tab that lies on the circumference of the container, wherein, in one embodiment, a pouring opening is exposed by peeling. For this purpose, the film lid consists of at least two layers, which are connected to each other by a peelable adhesive. The adhesive is applied only over a part of the surface of the film lid, and thus the upper layer of the lid there forms a tab for gripping in order to open the container. At a distance from the edge of the adhesive, a predetermined tear line is provided in the lower layer in the form of an arc-shaped cut which has a convex curvature in the direction toward the tab and which ends 1 to 2 cm before the edge of the container. During the opening procedure, the area between the cut and the container edge remains adhering to the upper layer, the lower layer tears, starting from the end points of the cut and going as far as the container edge, comes free of the container edge in this area and thus exposes an "archway-shaped" portion as pouring opening. An opening suitable for the withdrawal of individual tablets, etc., is not thereby created.

A single-dose pack is known from DE 2 327 206. This is designed as a kind of blister pack with a special withdrawal opening, wherein an inner film with an arc-shaped slit covers the well, and, by means of a double-sided adhesive film provided only in the opening area, a cover film is applied congruently over the inner film. During the opening procedure, the cover film lifts the adhesive film along with it, and the thereby exposed slit in the inner film permits the withdrawal of the single packaged tablet. If a plurality of tablets are to be packaged, the individual wells are arranged next to one another, as is customary in blister films. This closure is not suitable for bottles.

It is often the case that said medicines, food supplements, vitamin preparations, etc., are not packaged individually in so-called blister packs but instead are sold in loose form in so-called medicine bottles made of glass or, in recent years, increasingly or indeed almost exclusively made of plastic.

These bottles are normally closed by a screw-type closure with a screw cap. To guarantee the integrity of the closure at the time of purchase, either a tamper-evident ring is provided on the cap and breaks the first time the cap is unscrewed, or a tamper-evident seal, in most cases of aluminum or a plastic composite, is provided in the inside of the cap and sealed over the edge of the neck of the bottle. This seal has to be peeled off by the user when he wants to get at the contents of the bottle, and it thus performs its guarantee function.

The use of such medicine bottles for pharmaceuticals, food supplements, etc., is in fact something of an anachronism when one considers that the package is produced and filled in an environment which, in terms of sterility and cleanliness, almost equates to the demands placed on an operating theater, and when one considers that the user attempting to withdraw a tablet (to make matters simpler in the text below we will always refer just to a tablet or tablets, the other specific names of the individual presentations being tacitly understood) almost always empties several tablets out of the bottle (in most cases onto a surface of which the hygiene is entirely questionable) and uses his fingers to put the tablets he does not need back into the bottle again, where they in many cases remain unused for months on end, during which time the sweat attached to them, the flakes of skin, etc., begin to decompose.

However, since there is still great commercial demand from end consumers for medicine bottles of this kind, and since these medicine bottles are also often preferred to the blister packs also on offer, there is a need for a better way of dispensing the tablets from the medicine bottles.

The object of the invention is therefore to provide a medicine bottle of this kind with a closure that makes it easier to withdraw individual tablets and that at least substantially prevents a plurality of tablets being emptied out when the bottle is shaken.

According to the invention, these aims are achieved by the features specified in the characterizing part of claim 1.

In other words, the closure does not consist simply of a screw-on or snap-on cap, but also of an at least two-layered seal which performs the guarantee function against tampering, and, when this seal is pulled off, an inner sheet, if appropriate a multilayered plastic film, remains on the edge of the opening, wherein this plastic film has a slit which is provided eccentrically on the circular film surface from near the circle edge to near the circle edge and has at least one portion which is concave with respect to the center of the circle and which thus forms, with the circle edge, an at least substantially lens-shaped or oval or circular surface which is connected by two webs to the remaining (larger) surface, the cover area. The two sheets are connected to each other across the entire surface, and the connection between inner sheet and bottle is fixed, that is to say it cannot be undone without destruction.

In this way, the part of the plastic film protruding inward from the imaginary chord of the two ends of the concave portion functions as a kind of brake on the tablets that are to be emptied out, and it thus facilitates the withdrawal of individual tablets from the medicine bottle. The rigid edge connection prevents the formation of an opening, as happens during the opening procedure in DE 195 23 754.

Figure 5:
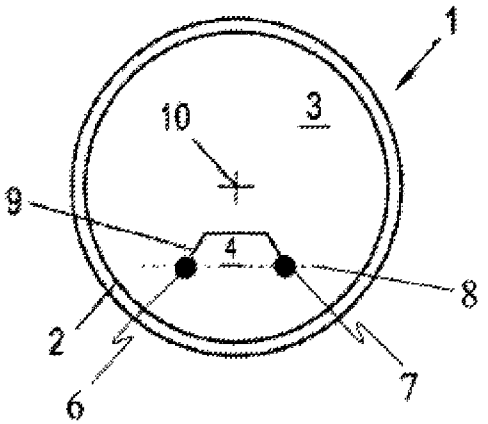

Seals of the kind that can be used according to the invention are known per se in various forms in the prior art, and reference is made only to WO 2008/006123 A of the applicant, thereby in particular also to FIG. 5 of this document. The material disclosed therein consists principally of two interconnected sheets, which can each be multilayered. The inner sheet is sealed onto the respective container edge and has, at a distance from the container edge, a closed line of weakness. The outer sheet can be pulled off, in most cases by means of a tab. Since the connection force between the two sheets is less than the force that connects the inner sheet to the container edge in the sealed area, the two sheets separate from each other and the area of the inner sheet that is delimited from the rest by the closed line of weakness remains attached to the pulled-off outer sheet, such that an opening in the inner sheet is exposed that is much smaller than the part which, by means of the remaining seal with the container edge, covers the opening.

This technology is principally used in order to avoid as far as possible any escape of liquid from containers after the outer sheet has been pulled off, and yet to still provide a drinking opening or to make available an opening for a drinking straw, or such like. This document was also published as US 2009/0311475 A1; the content of this document is incorporated by reference into the content of the present application, for the states in which this is possible.

A similar material with similar design and used for the same purpose is known from EP 812 782 A; the content of this document is also incorporated by reference into the content of the present application, for the states in which this is possible.

Another similar material with similar design and used for the same purpose is known from US 2004/0013827 A1 of the applicant; the content of this document is also incorporated by reference into the content of the present application, for the states in which this is possible.

Another similar material of similar design and used for the same purpose is known from WO 2006/113951 A1 of the applicant; the content of this document is also incorporated by reference into the content of the present application, for the states in which this is possible.

Another similar material of similar design and used for the same purpose is known from GB 2 027 664 A; the content of this document is also incorporated by reference into the content of the present application, for the states in which this is possible.

Another similar material of similar design and used for the same purpose is known from U.S. Pat. No. 4,735,335; the content of this document is also incorporated by reference into the content of the present application, for the states in which this is possible.

This technology was developed and refined in different ways over the years and adapted to various fields of application, but in no case hitherto were the slit or slits provided for any other purpose than to gain access to the inside of the container. This begins in the production of particularly small openings through which the overpressure in packages whose contents are heated in a microwave oven can escape or decrease. Access openings for drinking straws, or drinking openings, were already mentioned. Other openings are known for pouring out liquids while the cooked material, for example rice, is reliably held back.

Figure 1:
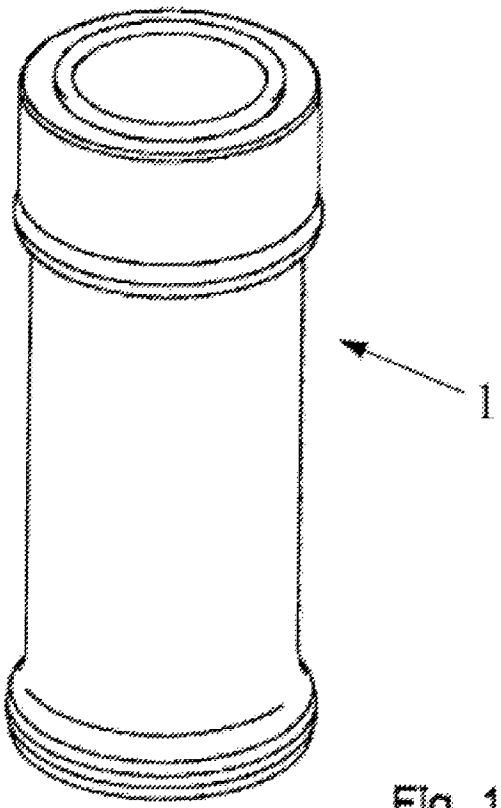
Figure 3:
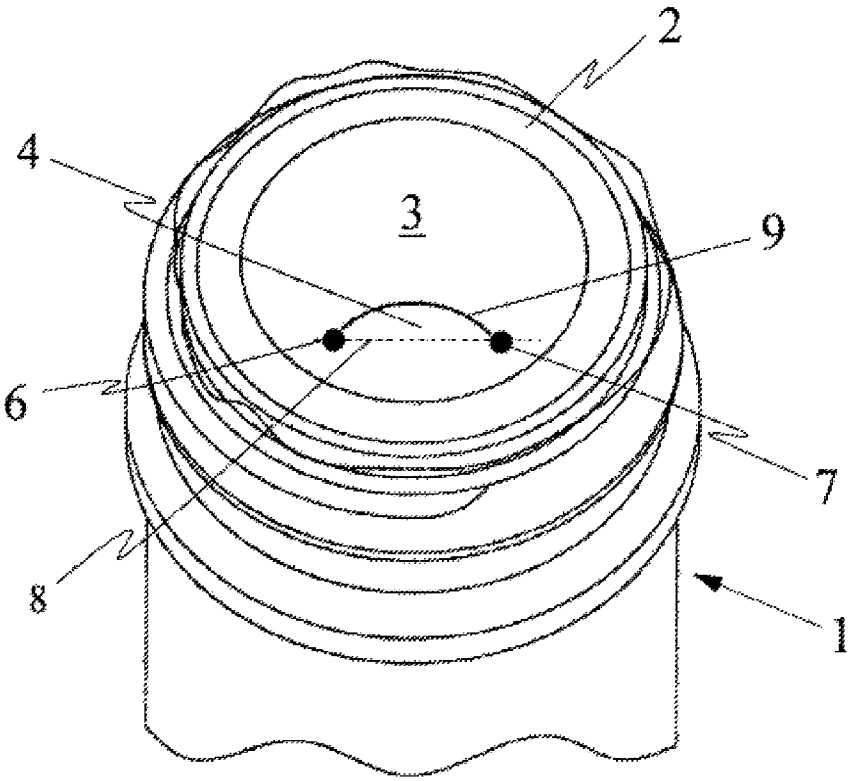

The invention is explained in more detail below with reference to the drawings, which are purely schematic depictions of a number of embodiments of the invention and in which the figures show:

FIG. 1: a medicine bottle with a closure according to the invention, in the closed state, FIG. 2: the medicine bottle from FIG. 1 with the screw cap removed and the tamper-evident closure intact, FIG. 3: a view of a medicine bottle as in FIGS. 1 and 2, with the tamper-evident closure pulled off and the withdrawal opening exposed, FIGS. 4 to 8: various forms of withdrawal openings according to the invention, in purely schematic plan views.

FIG. 1 shows the medicine bottle 1 with a closure according to the invention, in the closed state.

FIG. 2 shows the medicine bottle 1 from FIG. 1 with the screw cap removed and the tamper-evident closure or seal 12 intact. The seal 12 consists of two sheets, each of them in some cases having a multilayered structure, which sheets are connected to each other and can be peeled apart, namely an inner layer or cover sheet 3, of which the edge is sealed onto the circumferential edge of the bottle in a non-peelable manner, and an outer layer or sheet 13, which is connected peelably to the inner layer 3 across the entire surface area and has a tab 11 to allow peeling of the outer layer 13.

FIG. 3 shows the medicine bottle 1 with the outer sheet 13 pulled off, and thus with the tamper-evident closure opened, and the inner cover sheet 3 having a tongue area 4, which remains attached to the edge of the bottle 1 along a circumferential sealing edge 2, after the tamper-evident closure has been peeled off, and covers the bottle opening. A separation line 9 is provided eccentrically, i.e. between the center point 10 of the bottle opening and the circular sealing edge 2. It has two end points 6 and 7 which, in the illustrative embodiment shown, both lie closer to the sealing edge 2 than do all the other points of the separation line 9, such that the latter is concave, in the broadest sense of the word, in relation to the center point 10 of the plastic film 3.

The tongue area 4 is designated as such for the following reasons: If one imagines a straight line between the end points 6 and 7 of the separation line 9, the area of the inner film along this line forms a kind of hinge or a bending line 8 for the tongue area 4 of the film, which area is delimited with respect to this imaginary straight line by the separation line 9. This area in fact also functions as a tongue or a flap which, when the medicine bottle 1 is shaken in order to withdraw tablets or one tablet, acts like a tongue or a wing to counter the rolling movement of the tablets and thus ensures better singulation of the tablets coming from the medicine bottle 1.

In an advantageous embodiment (not shown), the tab 11 of the outer sheet (FIG. 2) lies near the tongue area 4, preferably in a continuation of the line between tongue area 4 and center point 10. This has the effect that, as the outer sheet is peeled off, the tongue area 4 is caught from the direction of the separation line 9, starting with the end points 6, 7, as a result of which a tearing-open in the area 5 (FIG. 8) or damage to the tongue area 4 is reliably avoided. The arrangement of tab and separation line and the opening procedure is therefore exactly diametrical to DE 195 23 754.

Figure 4:
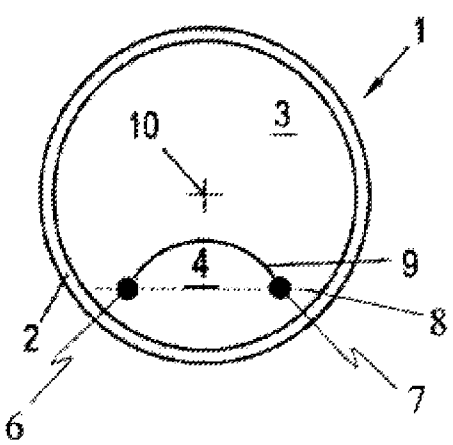

FIG. 4 shows a purely schematic plan view of the inner plastic film, the cover sheet, just as it is formed in FIG. 3. In this form, the separation line 9 extends more or less like an arc of a circle.

Figure 6:
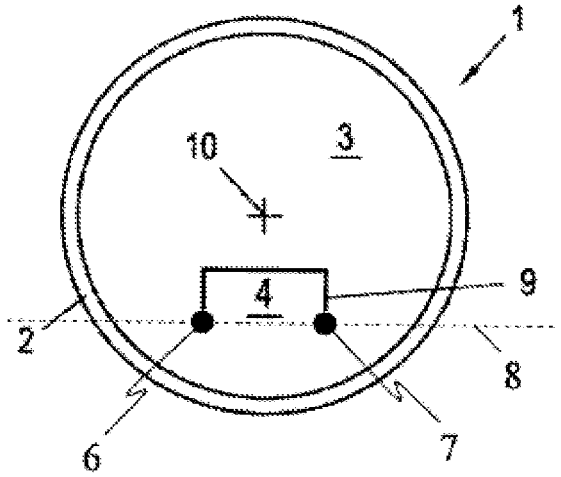
Figure 7:
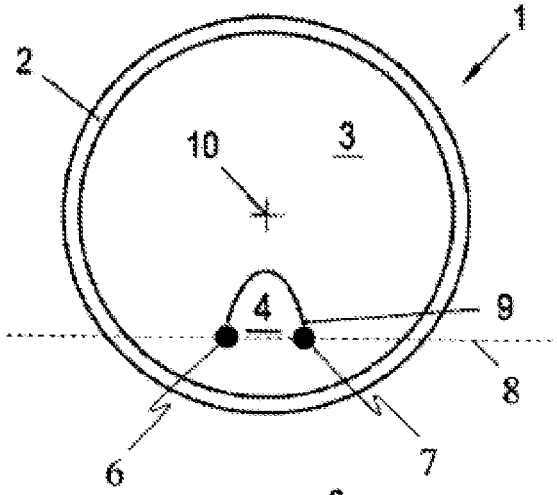

FIGS. 5 to 7 show similar views of differently designed separation lines 9, so as to give at least an illustration of the various possibilities. Thus, FIG. 5 shows a separation line 9 consisting of three rectilinear portions, which more or less represent the shape of three sides of a trapezoid. FIG. 6 shows a design with three rectilinear portions which form three sides of a rectangle, and FIG. 7 shows a design of the separation line 9 which is designed substantially in the shape of a horseshoe with end points 6 and 7.

The ends 6, 7 of the individual separation lines 9 define a bending line 8 for the respective tongue area 4, which bending line, if desired, can be regarded as a transition from the tongue area 4 to the cover area 3. This design of separation lines which are different, but which are each delimited by end points, and in which a connection of the tongue area 4 to the cover area 3 always remains, has the great advantage, over a design with an inherently closed separation line, for example a circular separation line, or with complete release of the bottle opening, that no loose part is formed that can fall into the content of the bottle, and that, during the withdrawal, the tongue area acts as a mechanical retainer for the content of the bottle.

Figure 8:
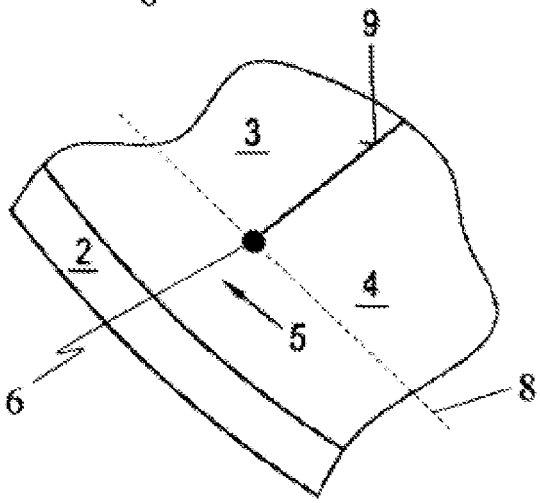

FIG. 8, depicting a detail on an enlarged scale, shows that a distance 5, or an uninterrupted profile in the area of this distance, is present between the tongue area 4 and the cover layer 3.

The size of the area or distance 5 can in itself amount to zero, but if the tamper-evident closure, when pulled off in this area, is provided with an undulating line of weakness intended to facilitate the peeling off between the two sheets of the tamper-evident closure, there is a danger that the plastic film will begin to tear here, as a result of which, on the one hand, the correct opening procedure is adversely affected and, on the other hand, the efficacy of the separation line 9 may be reduced. If there is no such line of weakness in this area in which the separation line 9 comes closest to the sealing edge 2, there are no technological reasons against the separation line 9 extending as far as the sealing edge 2.

It should also be noted that it is possible to arrange further portions outside the illustrated concave area of the separation line 9, although it will probably only be useful to do this in special cases, for example in the case of special (geometric) shapes of the tablets that are to be withdrawn, such that there will then be several end points or intermediate points delimiting the separation line portions.

A person skilled in the art, working in the field of production of seals and knowing of the invention, will be able to determine the size and shape of the separation line 9 on the basis of a small number of tests. Since only the plastic film is needed for this purpose, not the entire tamper-evident closure, this can be done without great effort in any laboratory run by a seal manufacturer.

The invention claimed is:

1. A system for dispensing a product in piecemeal fashion, comprising:

a bottle containing the product in loose form, the bottle having an opening defined by a circumferential, circular sealing edge; and a seal having at least two layers, including an inner layer that is sealed to the circumferential, circular sealing edge of the bottle, the inner layer including a curved or kinked slit disposed eccentrically to a center of the inner layer, the slit defining a tongue area which, in its area lying closest to the sealing edge, has a portion that is concave with respect to a center of the circle; and an outer layer that is removably attached to the inner layer across an entire surface of the inner layer;

wherein the seal is configured so that upon removal of the outer layer the tongue area remains attached to the inner layer.

2. The system of claim 1, wherein the outer layer includes a tab that is disposed on an edge of the outer layer adjacent to the tongue area, wherein the tab is configured to facilitate peeling the outer layer from the inner layer.

3. The system of claim 2, wherein a center point of the bottle opening, the tongue area and the tab are arranged in alignment.

4. The system of claim 1, wherein the tongue area is delimited by at least two end points of the slit and one or more bend lines extending through the end points.

5. The system of claim 4, wherein each of the end points of the slit is disposed at a distance that is greater than zero from the sealing edge.

6. The system of claim 3, wherein the tongue area is disposed between the center point of the bottle mouth and the tab.

7. The system of claim 1, wherein at least one of the inner layer and outer layer has a multilayered structure.

8. The system of claim 1, wherein the product contained by the bottle is a medicament, a food supplement, or a sweetener.

9. The system of claim 1, wherein the product contained by the bottle is configured to be dispensed piecemeal as a tablet, a pill, or a powder.

10. The system of claim 1, wherein the slit forms an arc of a circle.

* * * * *